US006244481B1

(12) United States Patent
Brougher

(10) Patent No.: US 6,244,481 B1
(45) Date of Patent: Jun. 12, 2001

(54) COMBINATION BACKPACK AND SEAT CUSHION

(76) Inventor: Kevin Brougher, 27824 - 50th Pl. S., Auburn, WA (US) 98001-1900

( * ) Notice: Subject to any disclaimer, the term of this patent is extended or adjusted under 35 U.S.C. 154(b) by 0 days.

(21) Appl. No.: 09/452,085

(22) Filed: Nov. 30, 1999

(51) Int. Cl.[7] ..... A45F 4/02

(52) U.S. Cl. ..... 224/153; 224/155; 224/582; 224/627; 297/118; 297/188.01; 297/188.2; 297/219.1

(58) Field of Search ..... 224/153, 155, 224/576, 577, 582, 586, 627, 642, 644, 655; 297/118, 219.1, 188.01, 188.2, 188.06, 188.04, 188.07

(56) References Cited

U.S. PATENT DOCUMENTS 3,763,972 * 10/1973 Karzmar ..... 297/188.2 X
4,236,657 * 12/1980 Brunton ..... 224/153
4,854,637 * 8/1989 McCree ..... 297/188.2
5,178,310 * 1/1993 Sowerby ..... 224/153
5,544,792 * 8/1996 Arnwine ..... 224/153
5,816,463 * 10/1998 Echeverri ..... 224/153 X
5,927,575 * 7/1999 Gatling ..... 224/153
5,988,465 * 7/1999 Vitale et al. ..... 224/153 X

* cited by examiner

*Primary Examiner*—Gregory M. Vidovich
(74) *Attorney, Agent, or Firm*—David L. Tingey

(57) ABSTRACT

A seat cushion comprising a large pad with a plurality of pocketed flaps attached thereto and foldable on the pad perimeter over the pad for carrying or away from the pad availing the pad as an unobstructed seat cushion. The flap pockets are directed inward toward the pad such that when the pad is in use as a cushion on a hard chair, such as a student's desk, the pockets are directed upward toward the user for convenient access. The most outside flap shares a zipper with the pad and when closed defines a cavity within in which the other flaps are secured, folded alternately over the pad. The cushion is transported on the user's back in the normal manner of a backpack by two arm loops through which the user may place his arm and shoulders, respectively, thus bringing the pad against the user's back as a cushion.

1 Claim, 3 Drawing Sheets

COMBINATION BACKPACK AND SEAT CUSHION

BACKGROUND

1. Field of the Invention

This invention relates to backpacks and, more particularly, to a backpack with pockets for transporting personal belongings that is carried on a user's back with a cushion between the user's back and the pockets as a comfort pad. The backpack cushion serves as a seat padding primarily for chairs and may also be used as a cushion for bleacher or stadium seats. Thus, for example, a student or sports fan is able to transport books, food, drink, clothing and the like to a school or a sports event in the backpack pockets and upon arrival unfold the pockets away from the cushion to avail the cushion as a soft seat over a desk seat or a hard bleacher bench.

2. Prior Art

Backpacks are commonplace in use, for example, as a carrier to conveniently transport a student's books and belongings to school, to transport a hiker's equipment and supplies, and other similar personal carrier use. The usual advantage is in supporting a substantial or inconvenient load on a user's torso, specifically the user's back, rather than the user's arms which would tire more quickly. It also frees up the user's arms for other use.

Seat cushions are also commonplace, for example, as portable pads that add comfort to a hard seating surface, such as hard desk chairs, bleachers or stadium seats. A sports fan may carry a seat cushion along with whatever other paraphernalia he might choose to have during a sporting event to the stadium, typically in bags or backpacks. It is known to have backpacks that anticipate that a user will want to carry a seat cushion or otherwise provide for a seat cushion. For example, U.S. Pat. No. 5,370,287 by Cormier teaches a cushion covered by a second member that together form a cavity for transporting belongings. When the second member is removed, the cushion is revealed, ready to sit on. U.S. Pat. No. 5,927,575 discloses a hunter's chair including a seat back and bottom strapped together and a detachable pack strapped to each seat bottom side to carry a hunter's supplies. During transport the pack is placed over the user's head with the seat back carried over the user's torso front and the seat back over the user's back with the side packs strapped to the seat bottom. U.S. Pat. No. 5,816,463 discloses a seat cushion pocket and pack for a stadium chair that straps the seat cushion in its pocket on the chair to a flap for holding personal belongings under the chair. For transport, the flap folds over the seat cushion pocket. It is not common, however, for a cushion to be adapted for use on a student desk seat while doubling as a book carrier.

None of the disclosures teaches a desk seat cushion with pockets for carrying books and personal belongings with the pockets folding away from the cushion and depending from the desk seat during use, the seat cushion also doubling as a backpack that is transportable on a user's back and a pad for buffering the pockets from the user's back.

SUMMARY

It is an object of the present invention to provide a seat cushion with a plurality of foldaway pockets for carrying personal belongings. It is a further object that the cushion also double as a backpack. It is a further object that the seat cushion-backpack be comfortably carried on the user's back with a cushion between the backpack pockets and the user's back.

These objects are achieved in seat cushion comprising a pad large enough for a user to sit on during use and having fold-away pockets attached to pad sides that hang down from the seat, such as a student desk seat, with the pockets opening upward for ease of access to the seated student. During transport, the pockets fold over the cushion pad and close together in the general look of a traditional backpack, the pad rests against the user's back. To support the cushion-backpack, two arm straps are provided with ends attached to the pad back forming arm loops through which the user may place his arm and shoulders, respectively, thus bringing a pad first face against the user's back with the flaps on a pad second face opposite the first face putting the pad between the user's back and the flaps.

An outside flap is provided of size approximately that of the cushion that typically includes at least one pocket inside and one pocket outside the flap. It folds over the cushion on a fold line shared between the cushion and the flap where they are attached on a common portion of the perimeter of each. A zipper is shared around the perimeter of each, releasably joining them together and enclosing a storage cavity within. A second flap also with at least one pocket is attached to the cushion inside the zipper, typically on a side opposite the outside flap, on a fold line on a perimeter portion common between them. Similar to the second flap, a third flap with at least one pocket may be foldably attached to the cushion also inside the zipper on another cushion side, and likewise can a fourth flap be attached. All flaps are foldable over the cushion alternately for carrying with the outside flap being the last as an outside cover zipping the other flaps in the cavity within. And all flaps are also foldable on their respective folds lines away from the cushion availing the cushion for sitting on without obstruction of the personal belongings within their pockets.

DETAILED DESCRIPTION OF THE PREFERRED EMBODIMENT

Figure 1:
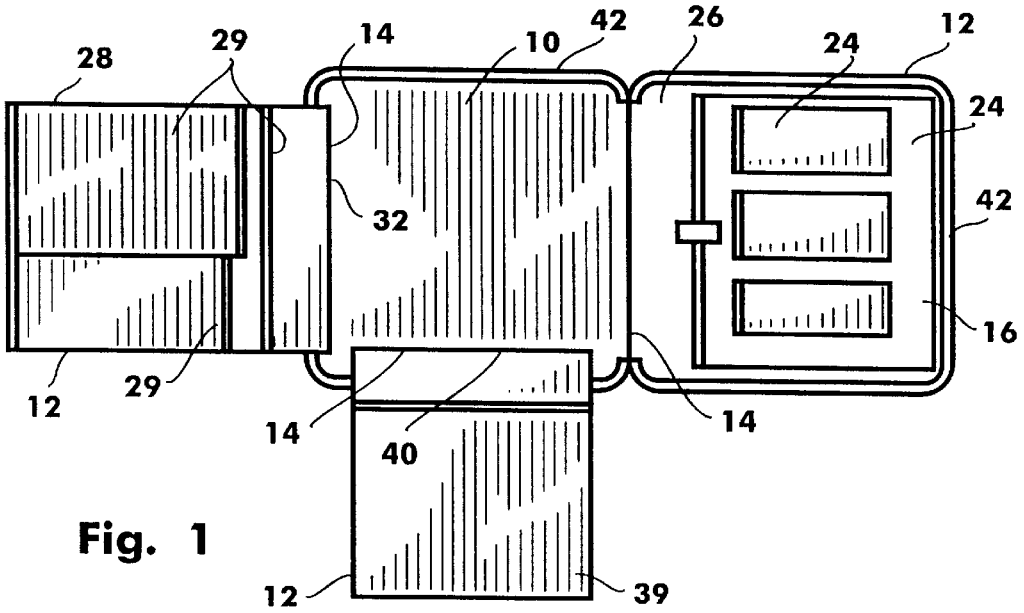
FIG. 1 is a front view of the opened backpack with flaps folded away from the center cushion.
Figure 2:
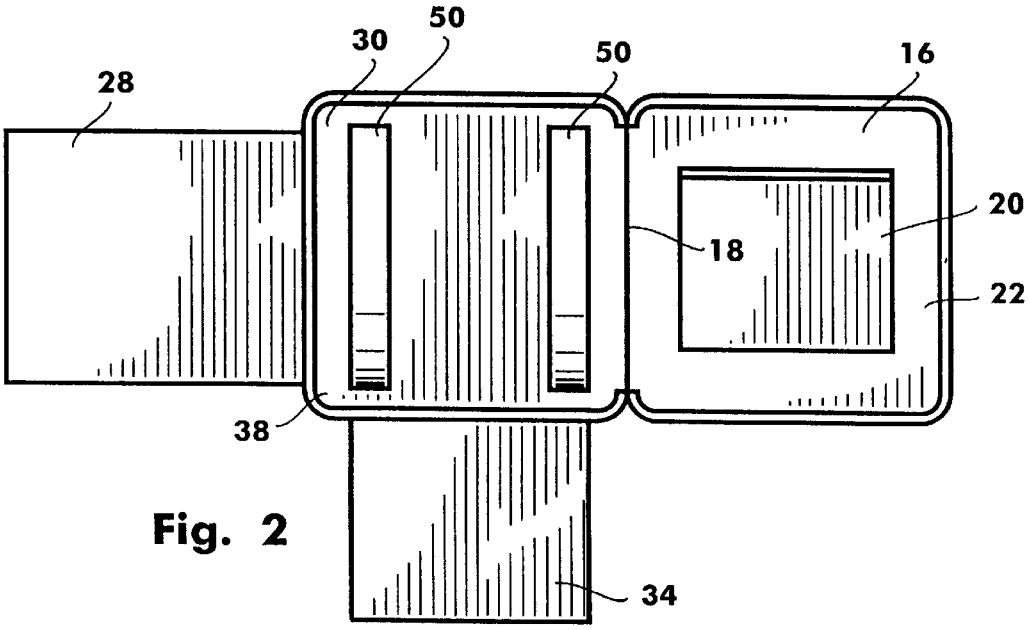
FIG. 2 is a back view of the opened backpack also with flaps folded away from the center cushion.
Figure 3:
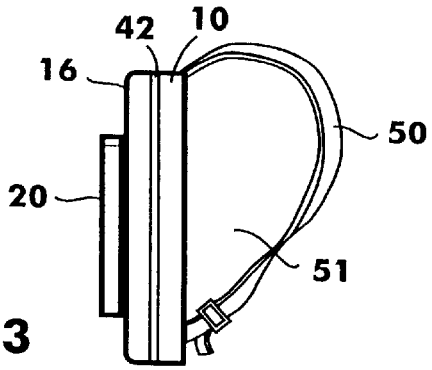
FIG. 3 is a side view of the closed backpack with flaps folded over the center cushion.
Figure 5:
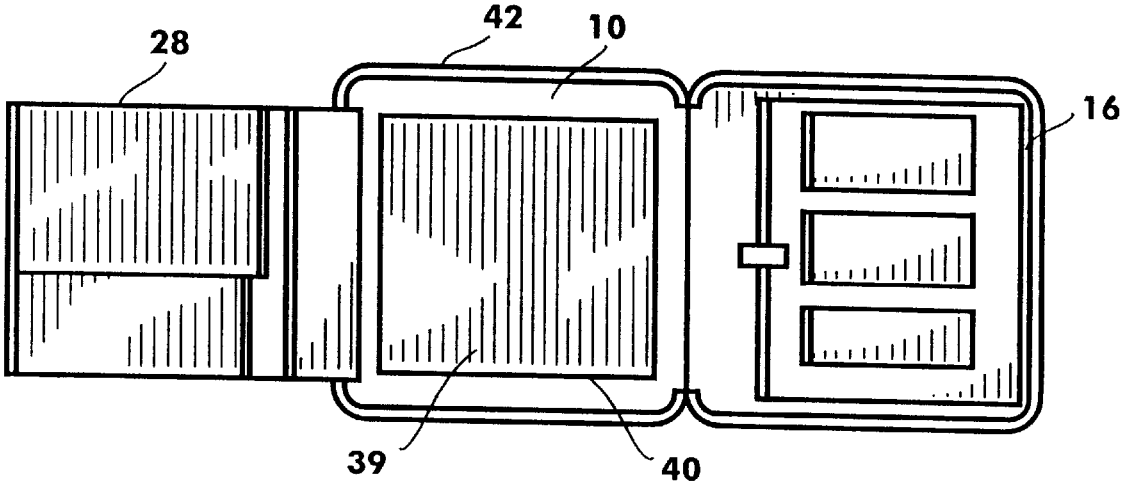
FIG. 5 is a front view of the backpack of FIG. 1 with one of three flaps folded over the center cushion.
Figure 6:
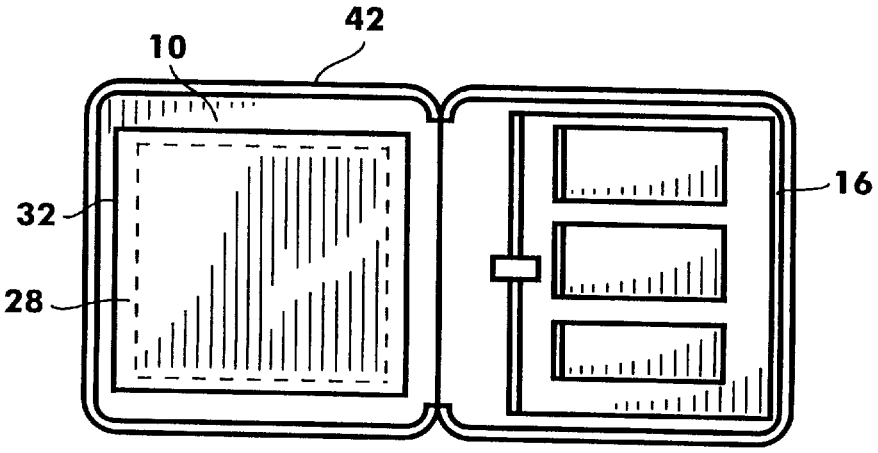
FIG. 6 is a front view of the backpack of FIG. 5 with two of three flaps folded over the center cushion.
Figure 4:
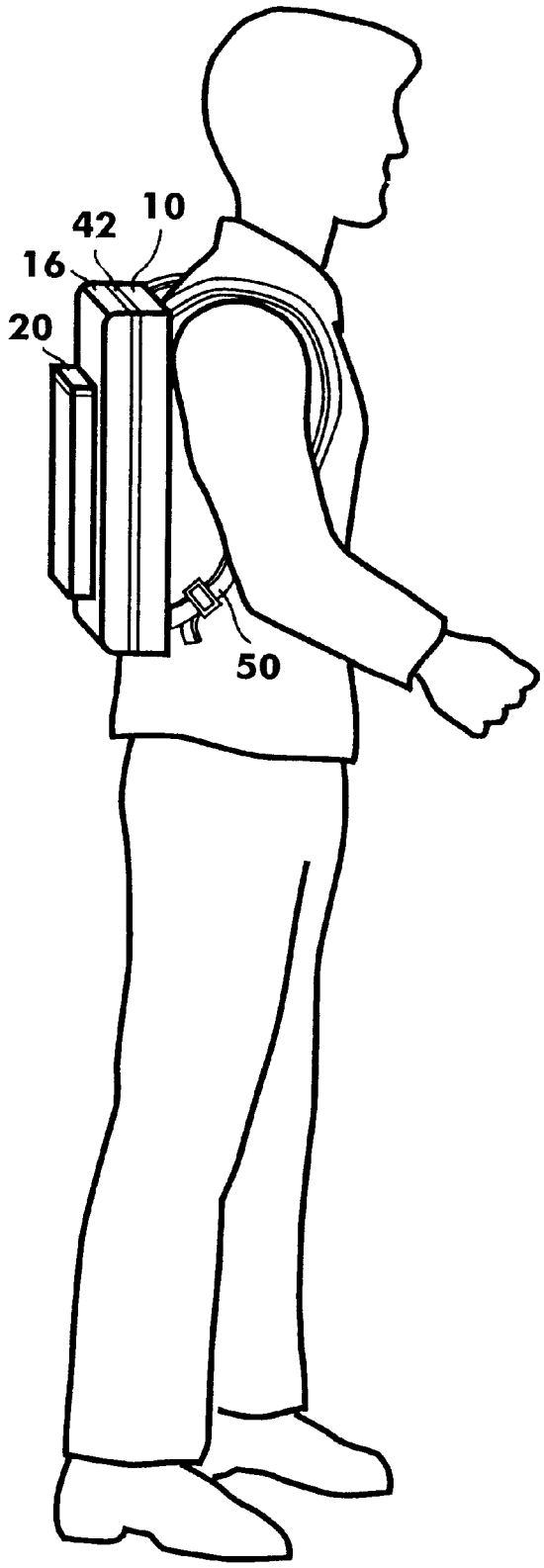
FIG. 4 is a perspective view of the backpack as carried on the back of a user.

The combination backpack and cushion, sized large enough to serve as a seat cushion, comprises a foam pad 10 (or a pad of any other similar soft and supportive material) and a plurality of flaps 12 foldable over the pad 10. Each flap joins the pad at or near their perimeters, the flap and pad each sharing a common perimeter portion at a fold line 14.

An outside flap 16 serves as an outer cover joined to the pad on a first pad side at first fold line 18. Typically, the outside flap includes at least one outer pocket 20 on the back 22 of the outside flap and inner pockets 24 on the front, or inner side, 26 of the outside flap. A second flap 28 is joined to the pad on a second pad side 30 at second fold line 32 also with at least one pocket 29. Typically, though not necessarily so, when there are only two flaps, the second flap is joined to the pad side 30 opposite the outside flap. A third flap 34 also with at least one pocket 39 may be joined to the pad on a third pad side 38 at a third fold line 40. The inner pockets 24, 29, and 39 open inward toward the pad such that during use with the pad on a chair such as a hard desk seat with the flaps attached to the pad depending from the chair, the inner pockets open upward for convenient access to a user on the pad.

The outside flap 16 and the pad 10 share a zipper 42 around their perimeters that close them together with the other flaps folded inside the zipper and over the pad, sandwiched between the outside flap and the pad in layer fashion. With the backpack opened and the flaps unfolded away from the pad, the pad is thus available as a seat cushion unobstructed by the flaps and whatever personal belongings might be in the flap pockets. With the flaps closed over the cushion the backpack is prepared as a carrier.

Typically two arm straps 50 are employed to support the backpack on the user's back. Each strap is attached with its top end secured to the pad top side and its bottom end secured at or near the pad bottom side. The figures show padded straps with the strap bottom ends secured to the pad side near the pad bottom, adjustable in length by use of a buckle and strap. Thus, the arm strap forms an arm loop 51 on the pad back. In use, the user places each of his or her arms and shoulders through an arm loop so the entire backpack is carried with the pad back resting comfortably as a cushion against the user's back.

What is claimed is:

1. A seat cushion with conveniently disposed pockets transportable as a backpack comprising a single cushioned pad with a plurality of sides about its perimeter, the pad sized sufficiently large for a user to sit on as a cushion, a plurality of uncushioned flaps including a first folding flap and subsequently folded flaps including an outer flap, each flap with a fold side in common with a respective one of the pad sides and forming a fold line, extending between fold line first and second ends, on which the flap folds from said respective one of the pad sides over the pad, all of the flaps and pad in stacked and overlapping disposition in a folded position with said first flap foldable in face-to-face contact with the pad and each of said subsequently folded flap foldable in face-to-face contact with a prior folded flap and unfolding away from the pad in an unfolded position, at least one pocket on each flap, the pocket opening inward toward the pad such that when the pad is placed on a chair, each flap of said plurality of flaps depends from the pad with the at least one pocket opening upward, a closing means half around the pad sides and a matching closing means half around the outside flap beginning at the fold line first end and continuing around perimeters of the outside flap and the pad to the fold line second end, releasably joining the outer flap and the pad together around their perimeters forming a closable envelope enclosing all other flaps, a first strap and a second strap each with both of its ends attached spaced apart on the pad with a first end attached high on the pad and a second strap end attached low on the pad forming an arm loop, the straps disposed on the pad with the pad and flaps adapted to be carried on a user's back with the pad resting as a cushion against the user's back on a pad first face with the flaps on a pad second face opposite the first face.

* * * * *